US006350027B1

(12) United States Patent
Iketani et al.

(10) Patent No.: US 6,350,027 B1
(45) **Date of Patent: *Feb. 26, 2002**

(54) INK TANK STRUCTURE

(75) Inventors: Masaru Iketani, Zama; Masaaki Okada, Sanjo; Yoichi Taneya, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/682,047

(22) Filed: Jul. 16, 1996

(30) Foreign Application Priority Data

Jul. 24, 1995 (JP) ..... 7-186904
Jul. 24, 1995 (JP) ..... 7-186909

(51) Int. Cl.[7] ..... B41J 2/175
(52) U.S. Cl. ..... 347/87
(58) Field of Search ..... 347/87, 86, 85

(56) References Cited

U.S. PATENT DOCUMENTS

| | | | | | |
|---|---|---|---|---|---|
| 4,771,295 | A | * | 9/1988 | Baker et al. | 347/87 |
| 5,182,579 | A | * | 1/1993 | Haruta et al. | 347/87 |
| 5,317,339 | A | | 5/1994 | Braun et al. | 347/87 |
| 5,481,289 | A | * | 1/1996 | Arashima et al. | 347/93 |
| 5,509,140 | A | | 4/1996 | Koitabashi et al. | 347/86 |
| 5,557,310 | A | | 9/1996 | Kurata et al. | 347/87 |
| 5,574,490 | A | * | 11/1996 | Gragg et al. | 347/87 |

FOREIGN PATENT DOCUMENTS

| | | | |
|---|---|---|---|
| EP | 0261764 | | 3/1988 |
| EP | 0408241 | | 1/1991 |
| EP | 0577439 | | 1/1994 |
| EP | 589 540 | A1 * | 3/1994 |
| JP | 03101971 | | 4/1991 |
| JP | 3-136866 | | 6/1991 |
| JP | 6-8468 | | 1/1994 |
| JP | 6-15845 | | 1/1994 |
| JP | 6320745 | | 11/1994 |
| JP | 6-328710 | | 11/1994 |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink tank for storing ink supplied to an ink jet recording head includes an ink tank body, an ink absorbing member inserted in the ink tank body in a compressed state, an atmosphere communicating port for communicating an inner space of the ink tank body with the atmosphere, and an ink supply port coupled to the ink jet recording head and serving as an ink supply port. A corner of the ink absorbing member which would be located near the atmosphere communicating port is cut out, a portion of the ink absorbing member around the cutout area is partly released in a degree of compression as compared with the other portion thereof under the state where the ink absorbing member is inserted in the ink tank body in a compressed state, and a space area is formed between the cutout area of the ink absorbing member and the atmosphere communicating port. The ink absorbing member is prevented from entering a buffer chamber, the ink impregnated in the ink absorbing member is uniformly supplied to the recording head, and the ink is prevented from leaking to the outside even if the cartridge is subjected to a thermal impact or a pressure reduced state.

14 Claims, 3 Drawing Sheets

INK TANK STRUCTURE

BACKGROUND OF THE INVENTION

1. Field of the Invention

The present invention relates to an ink jet cartridge for an ink jet recording apparatus wherein image information is recorded by ejecting ink or the like toward a recording medium.

2. Description of the Related Art

Heretofore, an ink jet recording apparatus wherein image information is recorded by ejecting ink or the like toward a recording medium has employed an ink jet cartridge comprising a recording head for forming droplets of the ink ejected toward the recording medium and an ink tank for containing the ink and supplying the ink to the recording head, the recording head and the ink tank being joined together.

FIG. 1 is a cross-sectional view showing the structure of one prior art ink jet cartridge.

As shown in FIG. 1, the prior art ink jet cartridge mainly comprises a recording head 27 from which ink is ejected toward a recording medium (not shown), and an ink tank 20 in which the ink to be ejected from the recording head 27 is stored. The ink tank 20 contains an ink absorbing member 21 for retaining the ink that is impregnated therein. Also, the ink tank 20 has an ink supply port 22 through which the ink retained by the ink absorbing member 21 is supplied to the recording head 27, and an atmosphere communicating port 23 through which the atmosphere outside the ink tank 20 is communicated with the air inside the ink tank 20 to prevent a negative pressure in the tank inner space from rising excessively. Further, as disclosed in Japanese Patent Laid-Open No. 3-101971, the ink tank 20 is provided on its inner wall surfaces with ribs 24 to 26 which serve to distribute the ambient air introduced through the atmosphere communicating port 23 to various portions of the ink absorbing member 21, enabling the ink impregnated in the ink absorbing member 21 to be evenly introduced to the ink supply port 22. In a portion of the rib 24 near the atmosphere communicating port 23, the height of the rib 24 projecting from the inner wall surface of the ink tank 20 is greater than in the other portion of the rib 24 so that the ambient air introduced through the atmosphere communicating port 23 is certainly supplied to the ink absorbing member 21.

In the ink jet cartridge described above, the ink impregnated in the ink absorbing member 21 is supplied to the recording head 27 through the ink supply port 22 by the capillary-attraction depending on consumption of the ink in the recording head 27. The ink is then ejected toward the recording medium from the recording head 27. Corresponding to the amount of the ink consumed, the ambient air is introduced to the ink tank 20 through the atmosphere communicating port 23.

In order to that the ink absorbing member 21 can properly retain the ink therein, the amount of the ink impregnated in the ink absorbing member 21 must be less than the volume of the ink absorbing member 21, while allowing the ink absorbing member 21 to develop the capillary attraction. To this end, a vacant space (a portion A in FIG. 1) where the ink is not impregnated from the beginning necessarily exists in the ink absorbing member 21. No matter where the vacant space exists, the ink absorbing member 21 can sufficiently develop its function of retaining the ink therein. But if the vacant space exists near the ink supply port 22, the ink flow may be blocked to prevent the ink from being supplied to the recording head 27. To avoid that the vacant space where the ink is not impregnated will exist near the ink supply port 22, the ink is poured into the ink tank through the ink supply port 22 in the manufacture process.

The ink poured through the ink supply port 22 flows through the ink absorbing member 21 and reaches the rib 26. Then, the ink passes gaps or guide paths formed by the ribs 26, 25 and 24 and comes to the side near the atmosphere communicating port 23. The ink is thus impregnated in the ink absorbing member 21 while finally leaving a vacant space in the portion A.

Here, the ink absorbing member 21 is inserted in the ink tank 20 in a compressed state.

In the prior art ink jet cartridge described above, however, because a portion of the rib 24 near the atmosphere communicating port 23 projects from the inner wall surface of the ink tank with greater height than in the other portion of the rib 24 so that the ambient air introduced through the atmosphere communicating port 23 is certainly supplied to the ink absorbing member 21, a portion B of the ink absorbing member 21 where it bumps the above higher portion of the rib 24 is brought into a more compressed state than in the other portion of the ink absorbing member 21 when the ink absorbing member 21 is inserted in the ink tank 20 in a compressed state. Therefore, when the ink is poured into the ink tank 20, the ink is impregnated in a more amount in the portion B of the ink absorbing member 21.

In practical use, there occur no problems even with the ink so impregnated in the ink absorbing member. But if the ink jet cartridge is subjected to a thermal impact or a pressure reduced state while it is delivered from the manufacture factory to the user, the air near the portion A expands, whereupon the ink accumulated in the portion B is pushed out to leak into a space where the atmosphere communicating port 23 is located. In the worst case, the leaked ink is forced to exude to the outside of the ink jet cartridge, resulting in a feat that the user's hands or cloth may be stained with the ink leaked out when the user opens the cartridge package.

Also, it is thought that the cartridge package is opened under an atmospheric pressure as low as 0.7 in some cases depending on the altitude of the place where the user employs an ink jet cartridge. Under such a low atmospheric pressure, the ink may also leak to the outside of the ink jet cartridge as with the foregoing case.

To prevent the leakage of ink in those situations, a buffer chamber is generally provided between the atmosphere communicating port 23 and the ink absorbing member 21, making it hard for the ink leaked out of the ink absorbing member 21 to exude to the outside of the ink jet cartridge. However, the volume of the buffer chamber is so very small that the function of the buffer chamber is not always developed satisfactorily.

Further, if the ink is impregnated in a portion of the ink absorbing member 21 which enters the buffer chamber, the guide paths formed by the ribs for distributing the ambient air introduced through the atmosphere communicating port 23 to various portions of the ink absorbing member are blocked off. This raises the problem that the ink impregnated in the ink absorbing member is no longer uniformly supplied to the recording head 27.

SUMMARY OF THE INVENTION

The present invention has been accomplished in view of the above-stated problems in the prior art, and its object is to provide an ink jet cartridge which can prevent an ink absorbing member from entering a buffer chamber and which can uniformly supply ink impregnated in the ink absorbing member to a recording head.

Another object of the present invention is to provide an ink jet cartridge which can prevent ink from leaking to the outside even if the cartridge is subjected to a thermal impact or a pressure reduced state.

To achieve the above objects, the present invention provides an ink tank for storing ink supplied to an ink jet recording head, the ink tank comprising an ink tank body, an ink absorbing member inserted in the ink -tank body in a compressed state, an atmosphere communicating port for communicating an inner space of the ink tank body with the atmosphere, and an ink supply port coupled to the ink jet recording head and serving as an ink supply port, wherein a corner of the ink absorbing member which would be located near the atmosphere communicating port is cut out, a portion of the ink absorbing member around the cutout area is partly released in a degree of compression as compared with the other portion thereof under the state where the ink absorbing member is inserted in the ink tank body in a compressed state, and a space area is formed between the cutout area of the ink absorbing member and the atmosphere communicating port.

With the present invention constituted as set forth above, a corner of the ink absorbing member which would be located adjacent to a buffer chamber when the ink absorbing member is inserted in the ink tank, is cut out so that any part of the ink absorbing member will not enter the buffer chamber. Therefore, even if the ink absorbing member is pushed toward the buffer chamber when it is inserted in the ink tank while being compressed, the ink absorbing member can be surely prevented from entering the buffer chamber. Additionally, guide paths formed for supplying the ambient air introduced through the atmosphere communicating port to the ink absorbing member will not be blocked off.

Also, the ink absorbing member is configured such that when it is inserted in the ink tank, a space of which volume is at least 0.5 time the volume of a vacant space in the ink absorbing member where the ink is not impregnated, is left near the atmosphere communicating port. Therefore, even if the air contained in the ink absorbing member expands due to, e.g., a pressure reduction outside the ink tank and the ink is forced to leak out of the ink absorbing member corresponding the expansion of the air, the leaked ink is accommodated in the above space formed when the ink absorbing member is inserted in the ink tank, and the ink is surely prevented from leaking to the outside of the ink jet cartridge.

Further, a corner of the ink absorbing member is cut out so that the ink absorbing member will not contact a rib on the tank inner wall surface over a predetermined length near the atmosphere communicating port. Therefore, when the ink absorbing member is inserted in the ink tank in a compressed state, a portion of the ink absorbing member near the atmosphere communicating port is not compressed and no ink will be accumulated near the atmosphere communicating port.

DETAILED DESCRIPTION OF THE PREFERRED EMBODIMENTS

A preferred embodiment of the present invention will be described hereinafter with reference to the drawings.

Figure 1:
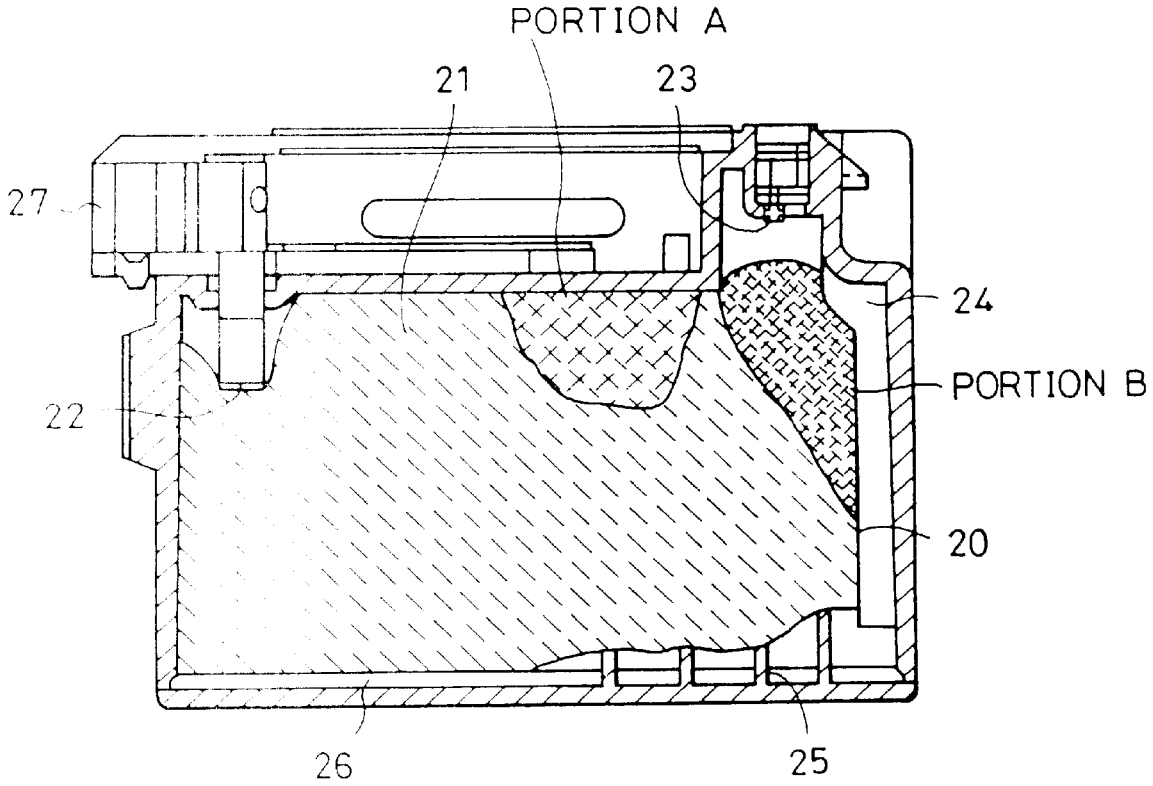
FIG. 1 (PRIOR ART)
FIG. 1 is a cross-sectional view showing the structure of one prior art ink jet cartridge.
Figure 2:
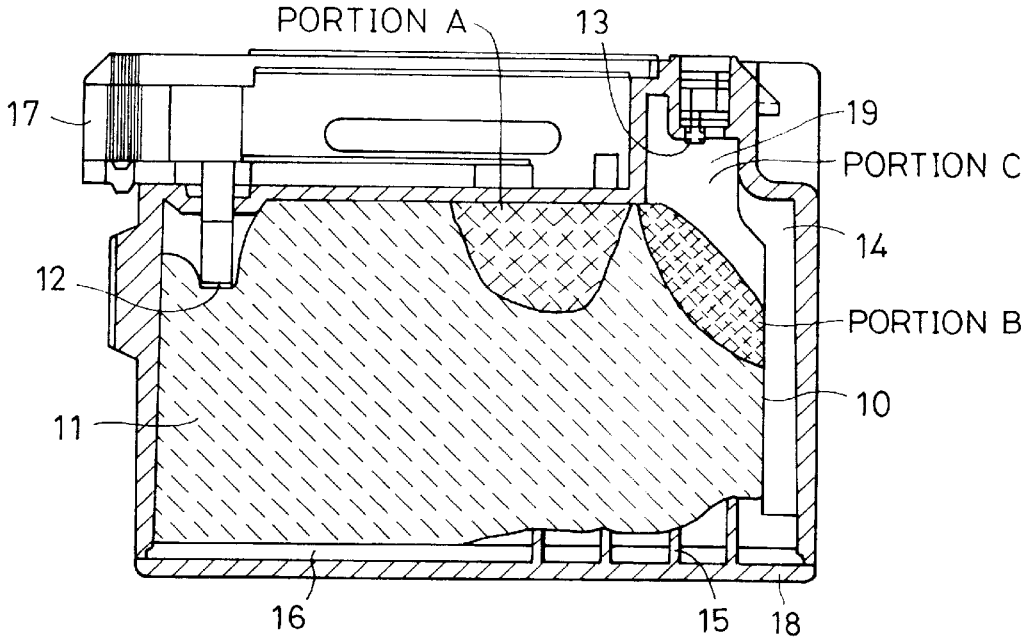
FIG. 2 is a cross-sectional view showing one embodiment of an ink jet cartridge of the present invention.

FIG. 2 is a cross-sectional view showing one embodiment of an ink jet cartridge of the present invention.

Figure 3:
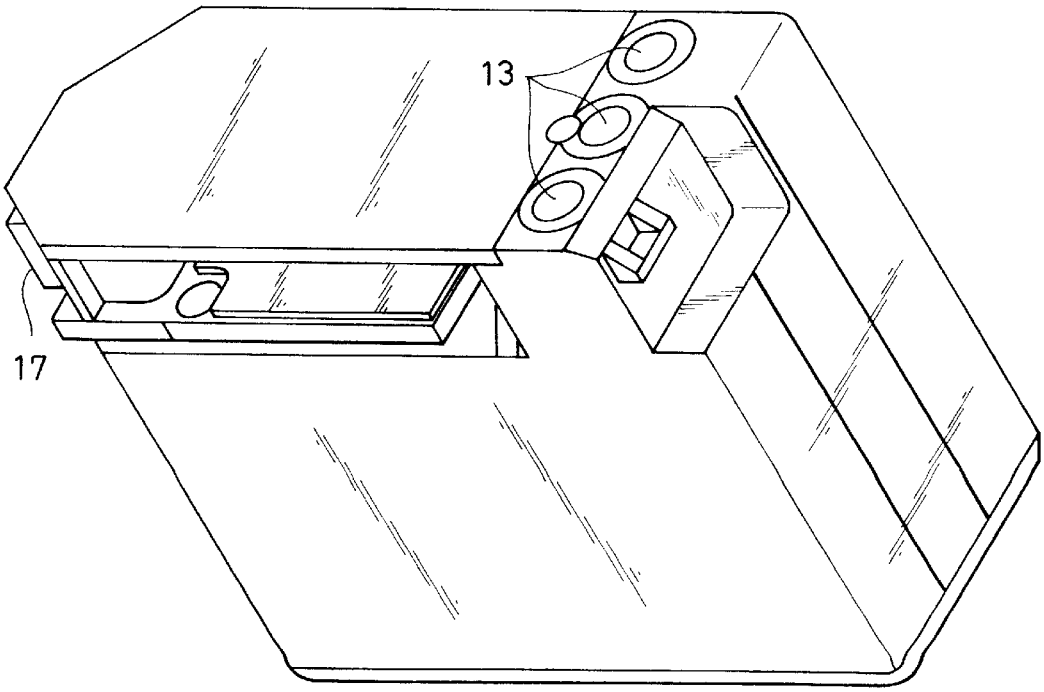
FIG. 3 a perspective view of the ink jet cartridge shown in FIG. 2.

FIG. 3 is a perspective view of the ink jet cartridge shown in FIG. 2.

As shown in FIG. 2, the ink jet cartridge of this embodiment mainly comprises a recording head 17 from which ink is ejected toward a recording medium (not shown), and an ink tank 10 in which the ink to be ejected from the recording head 17 is stored. The ink tank 10 contains an ink absorbing member 11 for retaining the ink that is impregnated therein. Also, the ink tank 10 has an ink supply-port 12 through which the ink retained by the ink absorbing member 11 is supplied to the recording head 17, and an atmosphere communicating port 13 through which the atmosphere outside the ink tank 10 is communicated with the air inside the ink tank 10 to prevent a negative pressure in the tank inner space from rising excessively. Further, the ink tank 10 is provided on its inner wall surfaces with ribs 14 to 16 which serve to distribute the ambient air introduced through the atmosphere communicating port 13 into various portions of the ink absorbing member 11, enabling the ink impregnated in the ink absorbing member 11 to be evenly introduced to the ink supply port 12. In a portion of the rib 14 near the atmosphere communicating port 13, the height of the rib 14 projecting from the inner wall surface of the ink tank 10 is greater than in the other portion of the rib 14 so that the ambient air introduced through the atmosphere communicating port 13 is certainly supplied to the ink absorbing member 11.

Further, a corner of the ink absorbing member 11 which would come into contact with the above higher portion of the rib 14 when the ink absorbing member 11 is inserted in the ink tank 10, is cut out so as to prevent any part of the ink absorbing member 11 from contacting the above higher portion of the rib 14. As a result, when the ink absorbing member 11 is inserted in the ink tank 10 in a compressed state, its part near the above higher portion of the rib 14 is not compressed.

In this embodiment, the volume occupied by the ink absorbing member 11 is 10.5 cc and the volume of the ink poured is 8.1 cc. Since the net volume of the ink absorbing member 11 (i.e., the volume of a spongy structure making up the ink absorbing member) is reduced 1.2 cc in a compressed state, the volume of the vacant space in the ink absorbing member 11 where the ink is not impregnated is 1.2 cc.

An experiment was carried out by placing the ink jet cartridge described above in a depressurization test box under 0.67 atm. As a result, it was found that no ink leaked to the outside of the ink jet cartridge. The reason is believed in that since a portion B of the ink absorbing member 11 is not compressed by the rib 14, almost no ink exists in the portion B and, therefore, even when the air in a portion A (vacant space) of the ink absorbing member 11 expands due to, e.g., a pressure reduction outside the cartridge, only the air is expelled to move out of the ink absorbing member 11 and the atmosphere communicating port 13 while the ink is kept impregnated in the ink absorbing member 11.

Further, if the inner space of the ink tank is not sufficiently depressurized during a step of pouring the ink, the poured ink may be impregnated in the portion B of the ink absorbing member 11 and may leak to the outside due to, e.g., a pressure reduction outside the cartridge. With the foregoing point in mind, an experiment was carried out by fabricating the ink jet cartridge of this embodiment under the condition where a degree of depressurization in the ink tank was intentionally lowered in the manufacture process, and placing it in a depressurization test box under 0.67 atm. As a result, it was confirmed that no ink leaked to the outside in the ink jet cartridge of this embodiment.

In this embodiment, the volume of a portion C in the tank inner space where the ink absorbing member 11 is not present is 0.6 cc that is 0.5 time the volume of the vacant space in the ink absorbing member 11 where the ink is not impregnated, i.e., 1.2 cc. Stated otherwise, it is estimated that the volume of the vacant space in the ink absorbing member 11 where the ink is not impregnated expands 1.5 times or less due to, e.g., a pressure reduction outside the cartridge. Therefore, by setting the volume of the portion C where the ink absorbing member 11 is not present to be 0.5 or more time the volume of the vacant space in the ink absorbing member 11 where the ink is not impregnated, the ink is surely prevented from leaking to the outside even if the air in the ink absorbing member 11 expands due to, e.g., a pressure reduction outside the cartridge.

An ink jet cartridge to which this embodiment is applied has a structure comprising three ink tanks 10 joined together, as shown in FIG. 3. Accordingly, each of the ink tanks is constructed as a relatively thin structure. By applying the present invention to such a thin ink tank, however, it is possible to suppress the leakage of ink through the atmosphere communicating port satisfactorily from the standpoint of practical use.

A recording apparatus mounting the foregoing ink jet cartridge thereon will be described below.

Figure 4:
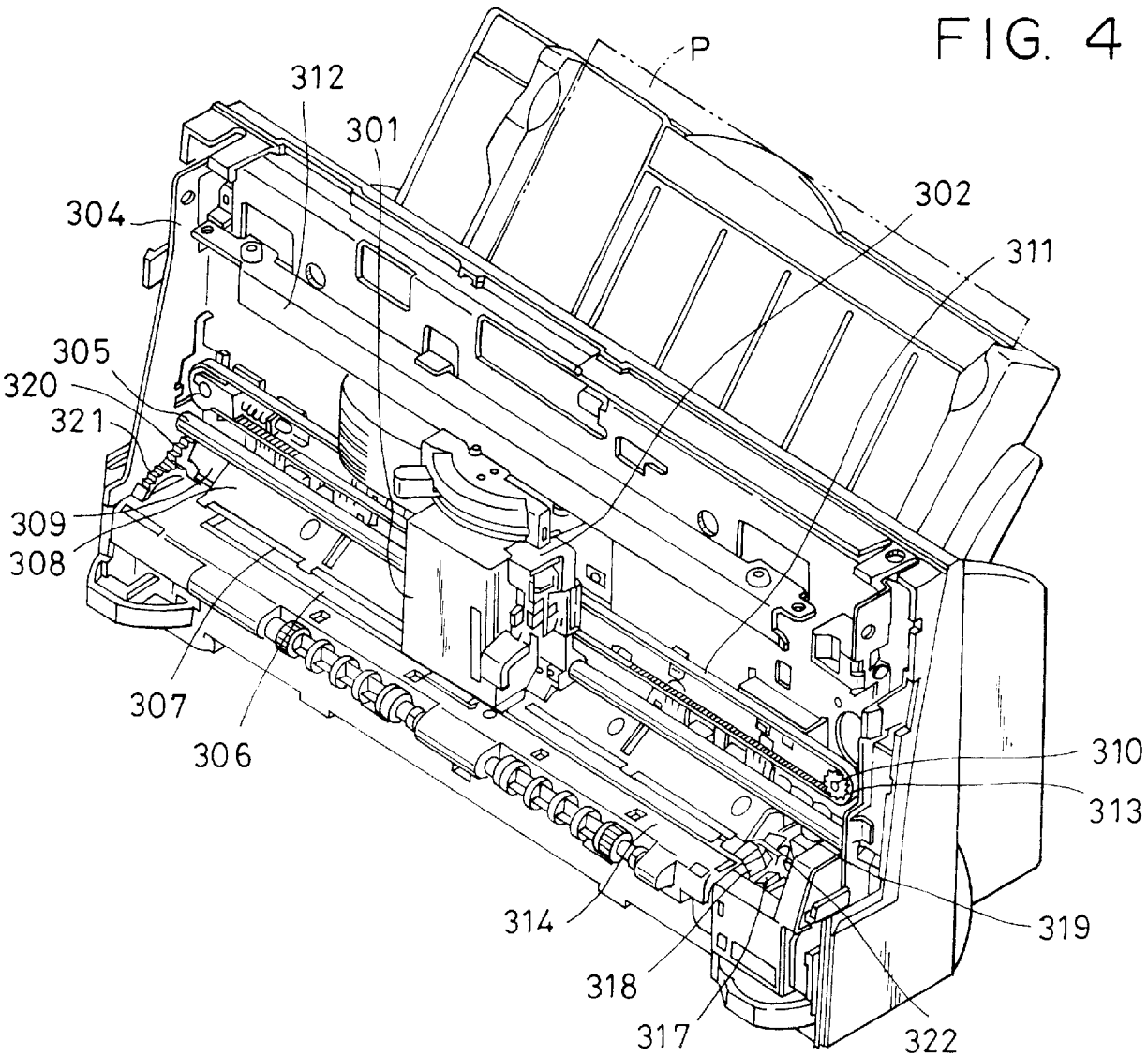
FIG. 4 is a perspective view showing one embodiment of a recording apparatus on which the ink jet cartridge of the present invention is mounted.

FIG. 4 is a perspective view showing one embodiment of a recording apparatus on which the ink jet cartridge of the present invention is mounted.

The ink jet recording apparatus shown in FIG. 4 comprises at least a pickup roller 309, a feed roller 306 and a pinch roller 307 for jointly feeding a recording medium P, an ink Jet cartridge 301 which is a recording means for recording image information on the recording medium P, a carriage 302 on which the ink jet cartridge 301 is mounted, a guide shaft 305 and a guide rail 312 which are fixed at their opposite ends to a frame 304 and support the carriage 302 such that the carriage is slidable in a direction perpendicular to the feed direction of the recording medium P and in a direction parallel to the plane of the recording medium P, a carriage driving belt 311, a carriage driving motor 310 and a driving pulley 313 for jointly reciprocally moving the carriage 302 in a linear, direction, a home position sensor 319 for controlling the stop position of the carriage 302, a pressure plate 308, and a base 314.

Outside the recording area, there are provided a wiper 318 and a cap 317 for respectively cleaning and capping the ink jet cartridge 301, an LF gear 321 for. transmitting the power of a feed motor (not shown) to the feed roller 306, the LF gear 321 being provided at one end of the feed roller 306, as well as a clutch gear 320 and a pump gear 322 for transmitting the power from the LF gear 321 to the cap 317. In the above arrangement, when the pickup roller 309 and the feed roller 306 are rotated, the recording medium P is drawn to advance to a position facing the ink ejecting surface of the ink jet cartridge 301 in this condition, the carriage driving motor 310 is driven to rotate the carriage driving belt 311, causing the carriage 302 to reciprocally move in a linear direction along the guide shaft 306 and the guide rail 312. At the same time, ink is ejected in accordance with a recording signal from the ink jet cartridge 301 mounted on the carriage 302. As a result, the image information to be obtained is recorded on the recording medium P.

Furthermore, a corner of the ink absorbing member 11 which would be located adjacent to a buffer chamber 19 when the ink absorbing member 11 is inserted in the ink tank 10, is cut out so that any part of the ink absorbing member 11 will not enter the buffer chamber. Accordingly, even if the ink absorbing member 11 is pushed toward the buffer chamber 19 when it is inserted in the ink tank 10 while being compressed, the ink absorbing member 11 is surely prevented from entering the buffer chamber 19.

The above feature is particularly advantageous for the ink jet cartridge having a structure where the ink absorbing member 11 tends to be pushed toward the buffer chamber 19 with stronger forces, as experienced, e.g., when the ribs 15, 16 are provided on the inner wall surface of the ink tank defined by a tank lid 18 as shown in FIG. 2.

For the ink jet cartridge thus constructed, the amount of the ink remaining in the ink absorbing member 11 was examined after repeating the printing operation until ink was no longer ejected from the recording head 17. As a result, it was confirmed that the amount of the remaining ink was less than that in a comparative ink jet cartridge wherein the ink absorbing member 11 partly entered the buffer chamber 19.

The present invention constituted as described above can provide advantages as follows.

The ink absorbing member is configured such that when it is inserted in the ink tank, a space of which volume is at least 0.5 time the volume of the vacant space in the ink absorbing member where the ink is not impregnated, is left near the atmosphere communicating port. Therefore, even if the ink jet cartridge is subjected to a thermal impact or a pressure reduced state, the ink leaked out of the ink absorbing member is accommodated in the above space formed when the ink absorbing member is inserted in the ink tank, and the ink can be surely prevented from leaking to the outside of the ink jet cartridge.

Also, a corner of the ink absorbing member is cut out so that the ink absorbing member will not contact the rib on the tank inner wall surface over a predetermined length near the atmosphere communicating port. Therefore, when the ink absorbing member is inserted in the ink tank in a compressed state, a portion of the ink absorbing member near the atmosphere communicating port is not compressed and no ink will be accumulated near the atmosphere communicating port. In addition, air can be smoothly introduced to the inner space of the ink tank, a negative pressure can be stably maintained even upon the ink being consumed abruptly, and the printing quality can be improved. Moreover, since the ink tends to be easily consumed from a portion far from the ink supply port, it is possible to increase the availability of the ink retained in the ink absorbing member.

Further, according to the present invention, a corner of the ink absorbing member which would be located adjacent to the buffer chamber when the ink absorbing member is inserted in the ink tank, is cut out so that any part of the ink absorbing member will not enter the buffer chamber. Therefore, even if the ink absorbing member is pushed toward the buffer chamber when it is inserted in the ink tank while being compressed, the ink absorbing member can be surely prevented from entering the buffer chamber. As a result, it is possible to avoid a reduction in the volume of the buffer chamber and prevent the ink from leaking to the outside of the ink tank even if the pressure or temperature outside the ink tank is reduced or raised to a considerable extent.

Additionally, since the guide paths formed for supplying the ambient air introduced through the atmosphere communicating port to the ink absorbing member are not blocked off but kept open, the ink impregnated in the ink absorbing member can be evenly supplied to the recording head and, therefore, the ink can be used efficiently.

What is claimed is:

1. An ink tank for storing ink supplied to an ink jet recording head, said ink tank comprising:

an ink tank body, an ink absorbing member held in said ink tank body in a compressed state, an atmosphere communicating port for communicating an inner space of said ink tank body with ambient atmosphere, and an ink supply port coupleable to said ink jet recording head, wherein:

an area of said ink absorbing member which would be located near said atmosphere communicating port is cut out in a range of 2.5% to 6.0% with respect to volume of said ink absorbing member, a first portion of said ink absorbing member around the cutout area is partly released in a degree of compression as compared with other portions thereof under a state where said ink absorbing member is held in said ink tank body in a compressed state, and a space area is formed between the cutout area of said ink absorbing member and said atmosphere communicating port.

2. An ink tank according to claim 1, wherein said ink absorbing member has an air layer in said first portion under a state where ink is filled in said ink absorbing member, and said space area is formed to have a volume at least 0.5 or more times the volume of said air layer.

3. An ink tank according to claim 1, wherein ink is filled in said ink tank.

4. An ink tank according to claim 1, wherein said ink tank comprises three ink tanks joined together so that at least three kinds of ink can be stored in said ink tank.

5. An ink tank according to claim 4, wherein said three kinds of ink are yellow, magenta and cyan in color, and black color is created by mixing said three kinds of ink with each other.

6. An ink tank according to claim 1, wherein said ink absorbing member is formed of urethane foam.

7. An ink tank according to claim 1, wherein said ink absorbing member is formed of melamine foam.

8. An ink jet cartridge comprising:

an ink jet recording head; and an ink tank connected to said ink jet recording head for storing ink supplied to said ink jet recording head, wherein said ink tank comprises:

an ink tank body, an ink absorbing member held in said ink tank body in a compressed state, an atmosphere communicating port for communicating an inner space of said ink tank body with ambient atmosphere, and an ink supply port coupleable to said ink jet recording head wherein:

an area of said ink absorbing member which would be located near said atmosphere communicating port is cut out in a range of 2.5% to 6.0% with respect to volume of said ink absorbing member, a first portion of said ink absorbing member around the cutout area is partly released in a degree of compression as compared with other portions thereof under a state where said ink absorbing member is held in said ink tank body in a compressed state, and a space area is formed between the cutout area of said ink absorbing member and said atmosphere communicating port.

9. An ink jet cartridge according to claim 8, wherein said cartridge is detachably mounted on a carriage provided in an ink jet recording apparatus.

10. An ink tank according to claim 1, wherein said space area is a single joined space area comprising both the space area formed by partly cutting out said ink absorbing member and a space inherently formed in said ink tank body.

11. An ink jet cartridge comprising:

a recording head which records by ejecting ink toward a recording medium;

an ink tank body defining a space in which an ink absorbing member is placed for retaining ink;

an atmosphere communicating port for communicating air between said ink tank body and ambience;

a buffer chamber defining a buffer space extending outwardly beyond a space occupied by said ink absorbing member between said ink tank body and said atmosphere communicating port; and a rib which is provided in an inner wall of said ink tank body opposite to said buffer chamber and which biases the ink absorbing member toward said buffer chamber, wherein a part of said ink absorbing member located adjacent said buffer chamber is cut away, thereby to prevent a part of the ink absorbing member adjacent to said buffer chamber from entering said buffer space despite biasing by said rib.

12. A recording device comprising an ink jet cartridge according to claim 11, wherein said ink jet cartridge effects recording by ejecting ink toward a recording medium.

13. An ink jet cartridge according to claim 11, wherein said rib defines a first space adjacent the inner wall of said ink tank body and opposite to said buffer space, and further comprising an ink supply port for ink communication between said recording head and said ink tank body, said ink supply port being disposed remote from said buffer space and from said first space.

14. An ink jet cartridge according to claim 13, further comprising a second rib on a wall between sais buffer space and said first space, said second rib defining a second space, said second space for air communication between said buffer space and said first space.

* * * * *

UNITED STATES PATENT AND TRADEMARK OFFICE

CERTIFICATE OF CORRECTION

PATENT NO. : 6,350,027 B1
DATED : February 26, 2002
INVENTOR(S) : Masaru Iketani et al.

It is certified that error appears in the above-identified patent and that said Letters Patent is hereby corrected as shown below:

Title page,
Item [56] References Cited, FOREIGN PATENT DOCUMENTS, "03101971" should read -- 3-101971 --; and "6320745" should read -- 6-320745 --.

Column 1,
Line 56, "to" should be deleted.

Column 2,
Line 26, "more" should read -- greater --.

Column 3,
Line 10, "-tank" should read -- tank --

Column 5,
Line 19, "time" should read -- times --;
Line 40, "Jet" should read -- jet --;
Line 56, "for." should read -- for --; and
Line 64, "301 in" should read -- 301. In --.

Column 8,
Line 37, "a" should read -- ¶ a --; and
Line 53, "sais" should read -- said --.

Signed and Sealed this

Twenty-first Day of May, 2002

*Attest:*

*Attesting Officer*

JAMES E. ROGAN
*Director of the United States Patent and Trademark Office*